US005950474A

United States Patent [19]

George et al.

[11] Patent Number: 5,950,474

[45] Date of Patent: Sep. 14, 1999

[54] BENDING APPARATUS

[75] Inventors: Philip George, Modbury; Andros Andreas, Plymouth, both of United Kingdom

[73] Assignee: Eurobend Limited, Ermington, United Kingdom

[21] Appl. No.: 09/086,189

[22] Filed: May 28, 1998

[30] Foreign Application Priority Data

May 30, 1997 [GB] United Kingdom ..... 9711052

[51] Int. Cl.[6] ..... B21D 7/04; B21D 9/05

[52] U.S. Cl. ..... 72/159; 72/149

[58] Field of Search ..... 72/149, 154, 155, 72/157, 158, 159, 384, 387, 217, 369, 367.1

[56] References Cited

U.S. PATENT DOCUMENTS

| | | | |
|---|---|---|---|
| 4,727,738 | 3/1988 | Yogo | 72/157 |
| 4,843,859 | 7/1989 | Togoshi . | |
| 4,870,849 | 10/1989 | Traub | 72/149 |
| 5,042,287 | 8/1991 | Sartorio . | |
| 5,495,740 | 3/1996 | Schwarze | 72/149 |

FOREIGN PATENT DOCUMENTS

| | | |
|---|---|---|
| 36 44 251 A1 | 3/1987 | Germany . |
| 93 16 052 | 2/1994 | Germany . |
| 97/12699 | 4/1997 | WIPO . |

*Primary Examiner*—Joseph J. Hail, III
*Assistant Examiner*—Rodney Butler
*Attorney, Agent, or Firm*—Davis and Bujold

[57] ABSTRACT

A bending apparatus has a die, a first clamp for clamping an elongate work piece into engagement with the die forward of the transverse center line of the die on one side of the die and a second clamp for clamping the elongate work piece into engagement with the die forward of the transverse center line of the die on the other side of the die. The first and second clamps are rotatable around the axis of the die to bend the elongate work piece. The first and second clamps are each movable between a retracted position in which the clamp is separated laterally from the die and is located below the plane in which the work piece is to be bent and an engaged position in which the clamp is in clamping engagement with the die.

14 Claims, 4 Drawing Sheets

BENDING APPARATUS

BACKGROUND TO THE INVENTION

The present invention relates to a bending apparatus and in particular a bending apparatus in which an elongate work piece is clamped against a die and the clamp and die are rotated to bend the work piece around the die.

Conventionally with bending machines of this type, rotation of the clamp and die is unidirectional, so that only right hand or left hand bends may be formed. However, the work piece is mounted so that it may be rotated about its axis and bends may be formed in any direction. Bending machines of this type are however limited in that as the work piece is rotated about its axis, the portion of the work piece that has already been bent must remain clear of the bending machine.

Consequently, when forming complex bent work pieces, for example a serpentine shape, it is advantageous to have a bending machine that is capable of forming both right hand and left hand bends.

A problem with such dual handed bending machines is that a clamp suitable for producing bends of one hand will be incorrectly located for forming bends of the other hand. As a consequence, in dual handed bending machines produced hitherto, complex mechanisms have been required for correctly locating the clamp for bending on both hands.

The present invention provides a dual handed bending machine in which clamping means may simply and quickly be adjusted with respect to the bending die, to permit bending in a clockwise or anticlockwise direction.

SUMMARY OF THE INVENTION

In accordance with the present invention, a bending apparatus includes a die, a first clamp adapted to clamp an elongate work piece into engagement with the die forward of the transverse centre line of the die on one side of the die and a second clamp adapted to clamp an elongate work piece into engagement with the die forward of the transverse centre line of the die on the other side of the die, the first and second clamps being adapted to rotate about the axis of the die, the first and second clamps each being movable between a retracted position in which the clamp is separated laterally from the die and is located below the plane in which the work piece is to be bent and an engaged position in which the clamp is in clamping engagement with the die.

With the above invention, to bend the work piece in one direction, the work piece is clamped between one of the clamps and the die while the other clamp is in its retracted position, so that it does not obstruct the work piece as the clamp and die are rotated, and vice versa.

According to a preferred embodiment of the invention, the faces of the die against which the first and second clamps engage to clamp the work piece are inclined towards one another, so that the clamp and die may be rotated, in each direction, through more than 180°, thereby permitting the formation of 180° bends, after spring back of the work piece. In order to accommodate the non-parallel clamping faces of the die, means is provided for rotation of the die, so that it can be indexed to bring the clamping face parallel to the respective clamp.

BRIEF DESCRIPTION OF THE DRAWINGS

An embodiment of the present invention is now described, with reference to the accompanying drawings, in which.

DESCRIPTION OF A PREFERRED EMBODIMENT

Figure 1:
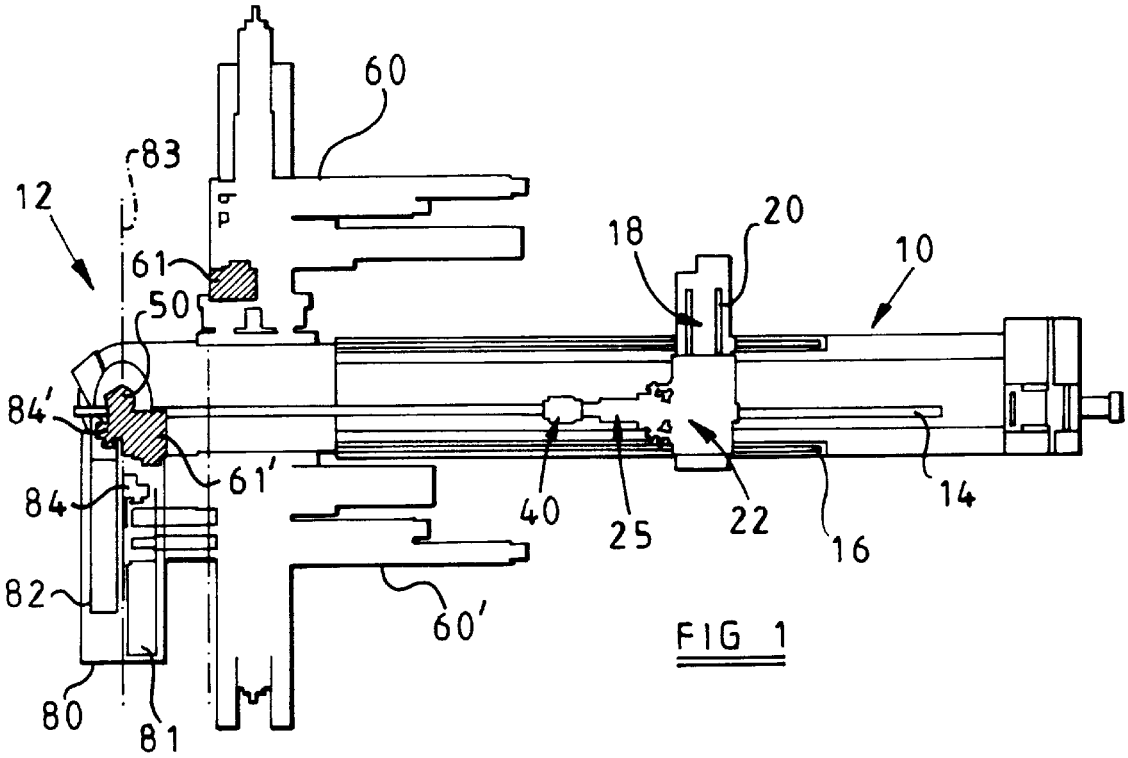
FIG. 1 is a diagrammatic plan view of a bending machine in accordance with the present invention.

As illustrated in FIG. 1, a tube bending machines includes a bed 10 with a bending head 12 at one end. A slide 16 is provided on machine bed 10 and a carriage 18 is mounted on the slide 16 allowing movement towards and away from the bending head 12. A cross-slide 20 is provided on the carriage 18 and a carriage 22 is mounted on the cross-slide 20, for movement transverse to the direction of movement of the carriage 18. Drive means (not shown) are provided for movement of the carriages 18 and 22.

A tube clamping assembly 25 is mounted on a carriage 22 by which an elongate work piece, for example a tube 14, may be clamped. The clamping assembly 25 is mounted on the carriage 22 on a vertical slide (not shown) so that the tube 14 may be moved vertically with respect to the machine bed 10. Furthermore, the clamping assembly 25 is preferably hollow so that the tube 14 may extend therethrough and is clamped by means of a collet 40, in the manner disclosed in UK Patent Specification No. GB2302831A, so that the tube 14 may be gradually fed through the collet 40. The clamping arrangement 25 may also be capable of rotating the tube 14.

As illustrated in greater detail in FIGS. 2 to 6, the bending head includes a die 50 which is of semi-circular configuration in plan with a pair of linear clamping faces 52,53 extending from a semi-circular portion 51. The clamping faces 52,53 converge together away from the semi-circular portion 51 of the die 50, at an angle of 30°.

A pair of semi-circular grooves 54,55 are formed in the semi-circular portion 51 and the clamping faces 52,53 of the die 50, the grooves 54,55 being of different diameter, corresponding to different diameter tubes 14.

The die is mounted on an axle 56.

A pair of guide assemblies 60,60' are mounted on the machine bed 10 one disposed on either side of the centre line of the machine bed 10.

Each guide assembly 60,60' comprises a guide block 61,61' having a linear guiding face 62 with a pair of semi-circular grooves 63,64, which correspond to the grooves 54,55 of the die 50.

The guide blocks 61,61' are each mounted on a slide 65,65' by which they may be moved axially of the machine bed 10 by drive means 66,66'. The slides 65,65' are in turn mounted on cross-slides 70,70', by which the guide blocks 61,61' may be moved towards and away from the centre line of the machine bed 10, by means of rams 71,71' each acting through a pair of links 67,68;67',68'. The cross-slides 70,70' are mounted on vertical slides 75,75' by which the guide blocks 61,61' may be moved vertically by means of rams 76,76'.

A clamping assembly 80 is mounted on the axle 56 for rotation about the axis of the die 50. The clamping assembly 80 comprises a pair of clamps 81,82, the clamps 81,82 being disposed parallel to one another one on either side of the centre line 83 passing through the axis of the die 50.

The clamps 81,82 each comprise a clamping block 84,84' having a linear clamping face 85 with semi-circular grooves 86,87 corresponding to the grooves 54,55 of the die 50. The clamping block 84 of one clamp 81 is arranged so that its clamping face 85 will engage the clamping face 52 of the die 50, forward of the transverse centre line of the die 50 on one side, while the clamping block 84' of the other clamp 82 is arranged so that its clamping face 85 will engage the clamping face 53 of the die 50, forward of the transverse centre line of the die 50 on the other side.

The clamping blocks 84,84' are each mounted with respect to a support member 90 by means of a parallelogram linkage 91,92;91',92' so that they may be moved in an arc between a retracted position and a clamping position, by means of rams 93,93' acting through linkage mechanism 94,95;94',95'.

Drive means (not shown) is provided for driving the clamping assembly 80 about the axis of die 50, in both clockwise and anticlockwise directions.

Means is also provided for rotating the die 50, so that the clamping faces 52,53 may be brought parallel to the corresponding faces 85 of the clamps 81 and 82 respectively.

As illustrated in FIGS. 2 to 5, to form an anticlockwise bend, the die 50 is rotated on the axle 56, so that clamping face 52 is aligned parallel to the longitudinal axis of the machine bed 10. The tube 14 is aligned by means of movement of carriages 18 and 22 so that it is disposed to the left hand side of the die 50 and engages in one of the grooves 54,55.

Figure 2:
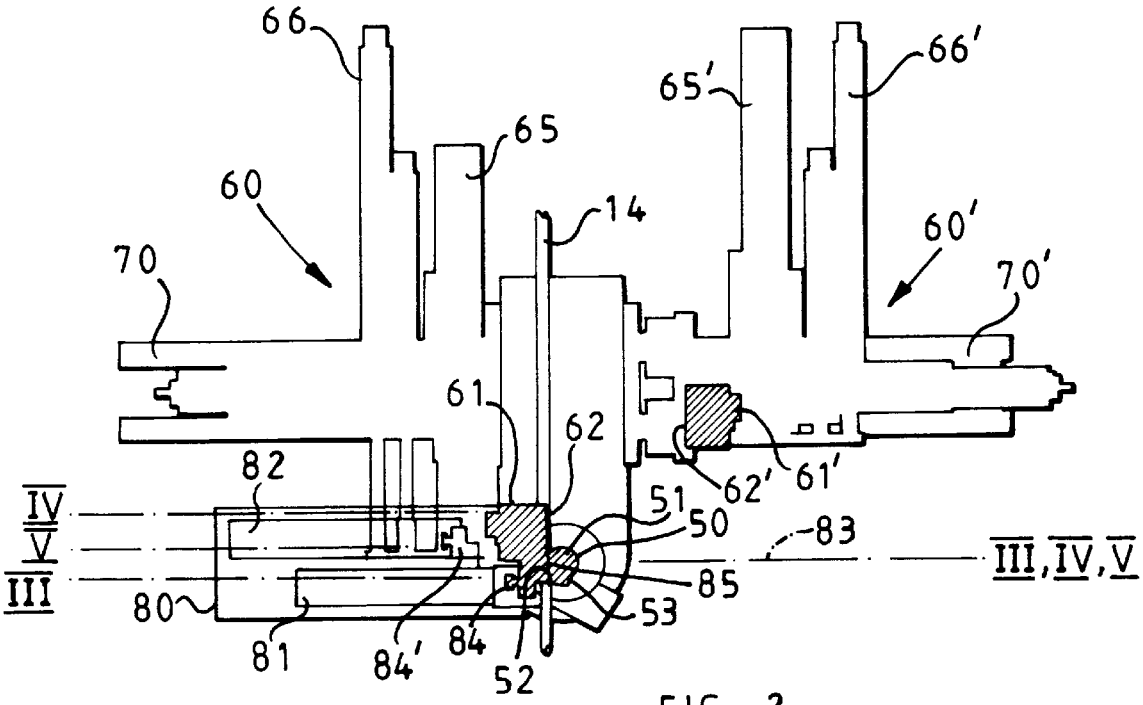
FIG. 2 is a plan view of the bending head of the bending machine illustrated in FIG. 1, set to produce an anticlockwise bend.
Figure 4:
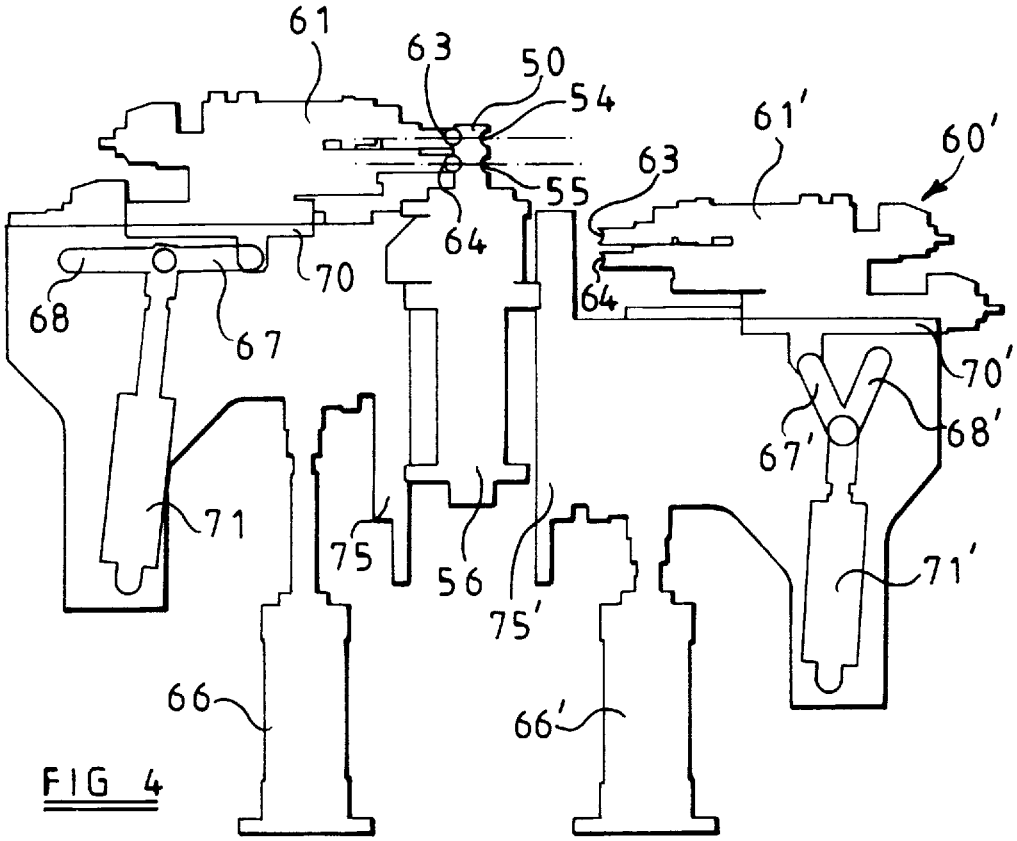
FIG. 4 is a section along the line IV—IV of FIG. 2.

As illustrated in FIGS. 2 and 4, the guide block 61 on the left hand side of the centre line of the machine bed 10, is lifted on slide 75 by means of ram 76 until it is level with die 50. The block 61 is then moved laterally on slide 70 by means of ram 71, until the tube 14 engages one of the grooves 86,87. This movement is achieved by extension of the ram 71 until the links 67,68 are linearly disposed, as illustrated in FIG. 4, so that they will withstand lateral loads applied to the guide block 61. Finally, the guide block 61 is advanced longitudinally of the machine bed 10 on slide 65, so that its leading edge is aligned with the transverse centre line 83 of the die 50.

The guide block 61' on the left hand side of the centre line of the machine bed 10, is moved to a position illustrated in FIG. 2, in which it is rearwardly and laterally spaced from the die and below the plane of bending, so that it will not interfere with the bending operation.

Figure 3:
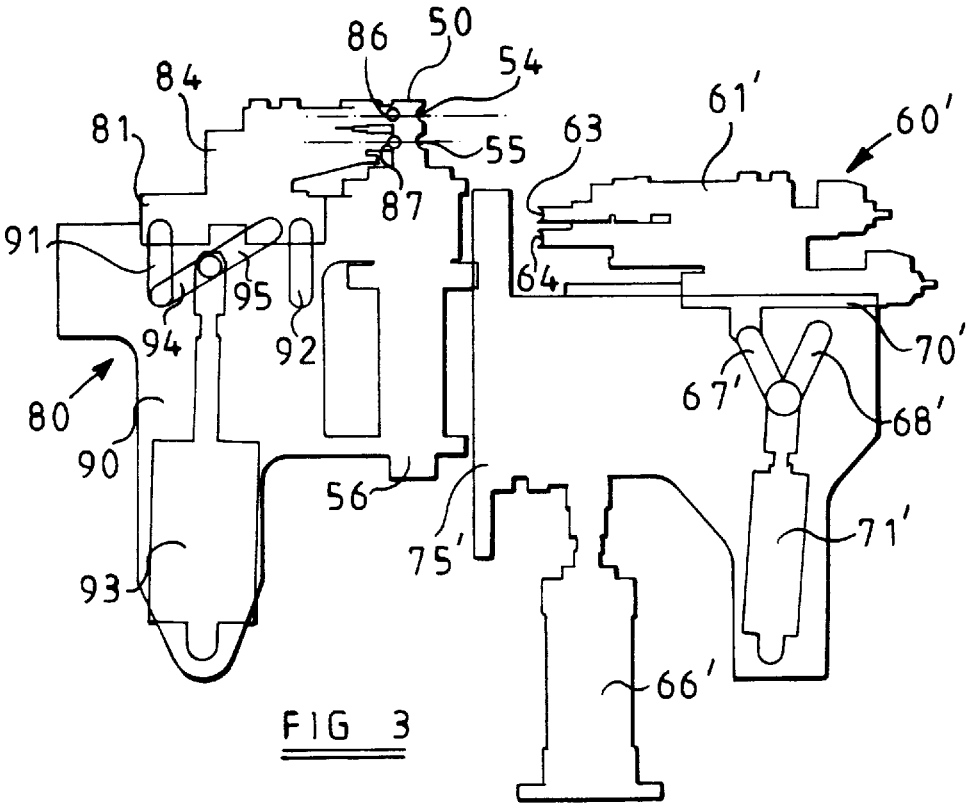
FIG. 3 is a section along the line III—III of FIG. 2.
Figure 5:
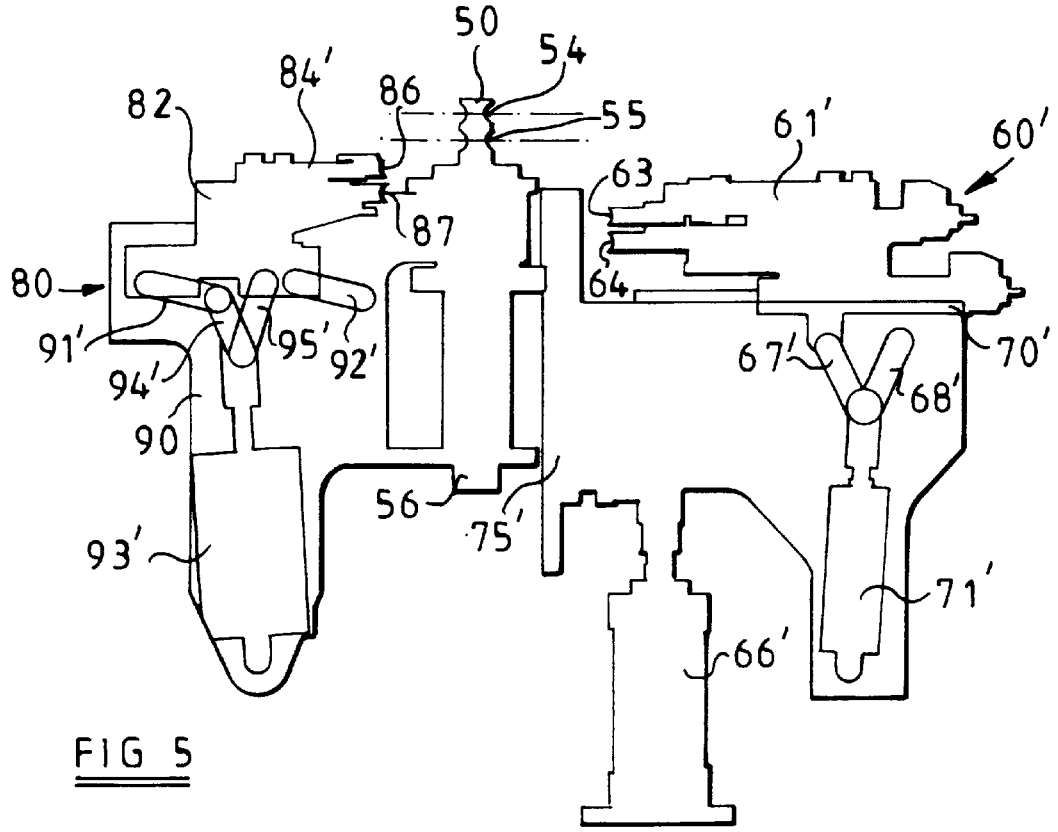
FIG. 5 is a section along the line V—V of FIG. 2.
Figure 6:
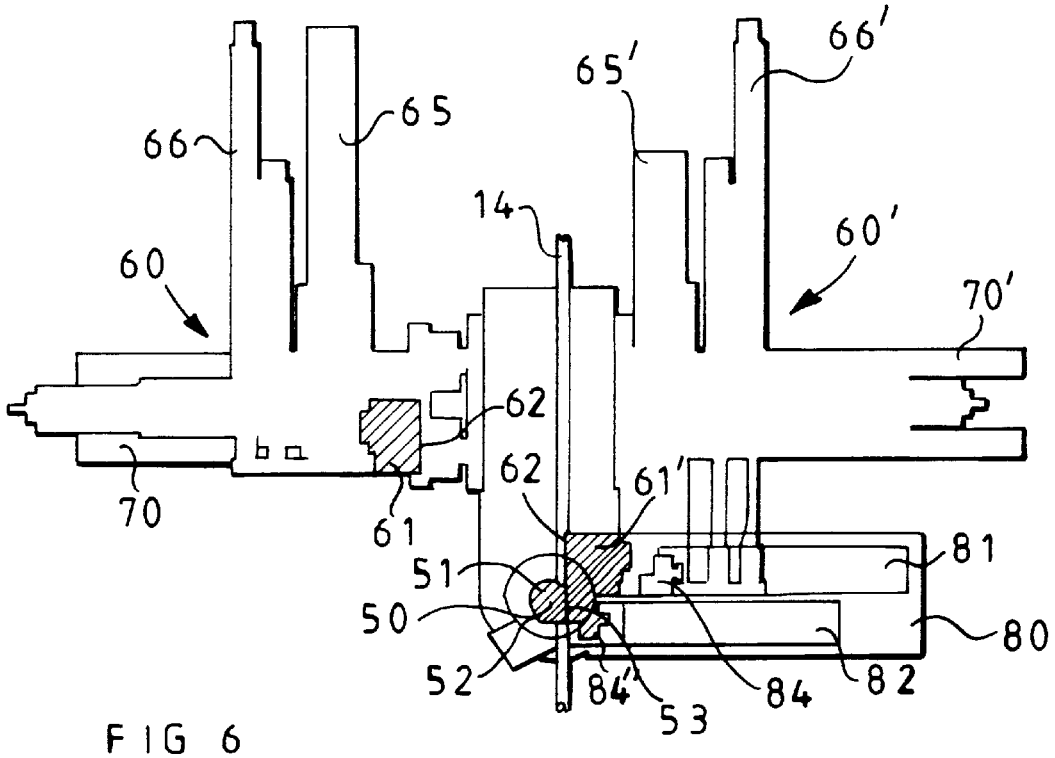
FIG. 6 is a view similar to FIG. 2 illustrating the bending machine set to produce a clockwise bend.

As illustrated in FIG. 2, the clamp assembly 80 is located on the left hand side of the die 50, so that the clamps 81 and 82 are disposed one on each side of the transverse centre line 83, clamp 81 being forward of the centre line 83 while clamp 82 is rearward of the centre line 83. Clamp 82 is located in its retracted position, below and spaced transversely from the die 50, as illustrated in FIG. 5. Clamp 81 is advanced to its clamping position as illustrated in FIG. 3, the ram 93 being extended and links 94,95 being disposed linearly so as to withstand any lateral loads on the clamping block 84. In the clamping position, the clamping block 84 of clamp 81, clamps a tube 14 between the clamping face 85 and the clamping face 52 of die 50.

Figure 7A:
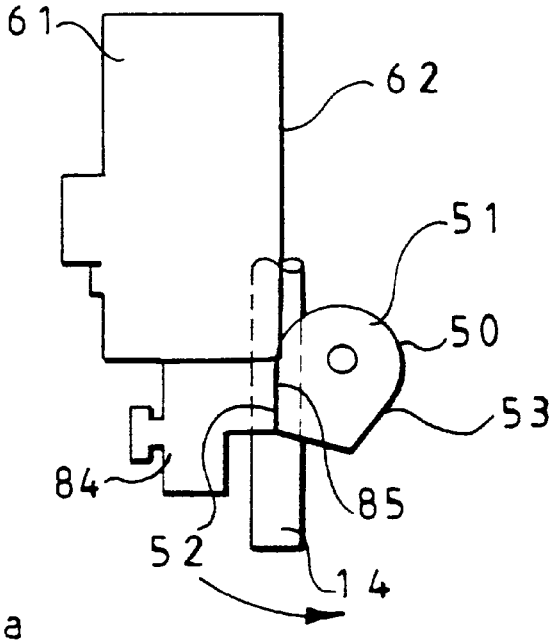
FIGS. 7*a* and 7*b* show a detail of FIG. 2, illustrating the formation of a bend.
Figure 7B:
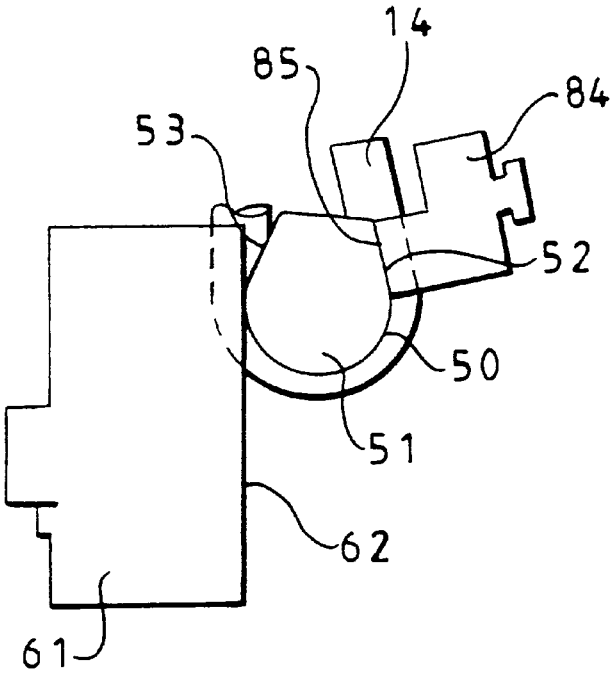

As illustrated in FIGS. 7*a* and 7*b*, to form the anticlockwise bend, the clamping block 84 of clamp 81 is then rotated with the die 50, to bend the tube 14 around the semi-circular portion 51 of the die 50. At the same time, the guide block 61 on the left hand side of the centre line of the machine bed 10, is advanced linearly on the slide 65, to maintain engagement of the tube 14 in the groove 54,55.

As illustrated in FIG. 7*b*, the converging clamping faces 52,53 of the die 50 permit the clamping block 84 of clamp 81 and the die 50 to be rotated through more than 180°, so that when clamp 81 is released and the tube springs back a 180° bend may be achieved.

After the bend has been formed, the clamp 81 may be released by retracting ram 93, so that clamping block 84 is moved in an arcuate path guided by links 91,92, to a position spaced laterally of the die 50, below the level of the die 50, as illustrated for clamp 82 in FIG. 5. The guide block 61 is also retracted to a position corresponding to the guide block 61 on the right hand side of the machine bed 10, by reversing the movements described above. The tube 14 may then be disengaged from the die 50 by movement of carriages 18 and 22.

To produce a right hand bend, the die 50 is rotated on axle 56 to bring clamping face 53 parallel to the longitudinal axis of the machine bed 10. The tube 14 is then repositioned by movement of carriages 18 and 22, so that it moves up and over the die 50 and engages one of the grooves 54,55 on the right hand side of the die 50. The guide block 61' on the right hand side of the centre line of the machine bed 10 is then position in similar manner to that described for the guide block 61 on the left hand side when producing an anticlockwise bend, while the clamping block 61 on the left hand side is retracted to a position corresponding to that of the clamping block 61' on the right hand side when producing an anticlockwise bend.

The clamping assembly 80 is swung about the axis of the axle 56 so that it is disposed on the right hand side of the die 50, when clamp 82 will be position forwardly of the transverse centre line 83 while clamp 81 is disposed rearwardly of the transverse centre line 83. The clamping block 84 of clamp 81 is then located in its retracted position while clamping block 84' of clamp 82 is moved by means of ram 93', into clamping engagement with the clamping face 53 of die 50.

A right hand bend may then be formed by rotating the clamping assembly 80 and die 50 in a clockwise direction.

Various modifications may be made without departing from the invention. For example, while the clamping blocks 84 are moved in an arcuate path by means of ram 93, they may alternatively be moved vertically and horizontally using separate rams in similar manner to the guide blocks 61. According to a further preferred embodiment, separate vertical and linear movement of the clamping blocks may be achieved in the manner disclosed in UK Patent Specification No. GB 2293784A. Similarly, the guide blocks 61 may be moved in a single arcuate path or in a combined arcuate and linear path.

While the present invention is suitable for bending tube, it may be used to bend any elongate work piece of uniform cross-section, for example rod or bar.

We claim:

1. A bending apparatus including a die supported about an axis of rotation, a first clamp for clamping an elongated work piece into engagement with the die forward of a transverse centre line of the die on one side of the die, a second clamp for clamping an elongate work piece into engagement with the die forward of the transverse centre line of the die on the other side of the die, the first and second clamps being arranged to rotate about said axis of the die, the first and second clamps each being moveable between a retracted position in which the clamp is separated laterally from the die and is located below the plane in which the work piece is to be bent and an engaged position in which the clamp is in clamping engagement with the die.

2. A bending apparatus according to claim 1 in which the first and second clamps are mounted on a clamp assembly, the clamp assembly being mounted for rotation about the axis of the die, the first and second clamps being mounted in juxtaposed relationship one on either side of a centre line passing through the axis of the die.

3. A bending apparatus according to claim 1 in which the first and second clamps each comprise a clamping block mounted for movement between a retracted position and a clamping position, means being provided to move each clamping block independently between the retracted position and the clamping position.

4. A bending apparatus according to claim 1 in which the die comprises a semi-circular portion with linear clamping faces extending forwardly of the transverse centre line of the die from the semi-circular portion, the first and second clamps being arranged to engage respective clamping faces on each side of the die.

5. A bending apparatus according to claim 1 in which the guide assemblies are provided one on either side of a centre line of a machine bed, each guide assembly comprising a guide block which is retractable between a retracted position in which it is clear of a plane of bending of the work piece and a guiding position in which it engages the work piece clamped to the die.

6. A bending apparatus according to claim 1 in which means is provided for moving the elongate work piece longitudinally, transversely and/or vertically of a machine bed.

7. A bending apparatus according to claim 1 in which means is provided for rotation of the elongate work piece about its axis.

8. A bending apparatus according to claim 3 in which the clamping block of each clamp is mounted on a parallelogram linkage for arcuate movement between the retracted position and the clamping position.

9. A bending apparatus according to claim 3 in which the clamping block of each clamping means is moved independently between the retracted position and the clamping position by means of a ram, the ram acting through a linkage mechanism comprising a pair of links, the links being disposed linearly of one another when the clamping block is in the clamping position.

10. A bending apparatus according to claim 4 in which the clamping faces of the die are inclined towards one another away from the semi-circular portion of the die.

11. A bending apparatus according to claim 10 in which the clamping faces are inclined towards one another at an angle of 30°.

12. A bending apparatus according to claim 10 in which means is provided for rotation of the die to bring the respective clamping face of the die parallel to a longitudinal axis of the machine bed.

13. A bending apparatus according to claim 5 in which the guide block is movable longitudinally of the centre line of the machine bed.

14. A bending apparatus according to claim 5 in which the guide block is movable between a retracted position in which it is located below and spaced transversely of the elongate work piece and the guiding position.

* * * * *